US006520195B1

(12) United States Patent
O'Neal et al.

(10) Patent No.: US 6,520,195 B1
(45) Date of Patent: Feb. 18, 2003

(54) PORTABLE SHELTER AND METHOD OF ASSEMBLING THE SAME

(76) Inventors: Robert O'Neal, 202 Chestnut St., Rehoboth, MA (US) 02769; Kenneth Hunibel, 95 Chestnut St., Rehoboth, MA (US) 02769; Anthony Green, 51 Bridge Path Cir., Randolph, MA (US) 02368

( * ) Notice: Subject to any disclaimer, the term of this patent is extended or adjusted under 35 U.S.C. 154(b) by 179 days.

(21) Appl. No.: 09/768,645

(22) Filed: Jan. 24, 2001

(51) Int. Cl.[7] ..... A45B 25/00
(52) U.S. Cl. ..... 135/94; 135/123; 135/143
(58) Field of Search ..... 135/94, 98, 99, 135/139, 143, 147, 33.7, 123

(56) References Cited

U.S. PATENT DOCUMENTS

| | | | | |
|---|---|---|---|---|
| 641,586 | A | * | 1/1900 | French |
| 833,411 | A | * | 10/1906 | Ormsby |
| 1,204,616 | A | | 11/1916 | Upton |
| 1,522,644 | A | | 1/1925 | Munson |
| 1,601,889 | A | | 10/1926 | Silverstein |
| 1,669,611 | A | | 5/1928 | Goldberg |
| 2,335,184 | A | * | 11/1943 | Houseman |
| 3,213,868 | A | | 10/1965 | Forbes |
| 3,374,798 | A | | 3/1968 | Samuelson |
| 3,889,698 | A | | 6/1975 | Roessl |
| 4,813,442 | A | | 3/1989 | Haines |
| 4,844,108 | A | | 7/1989 | Rohrer |
| 5,090,435 | A | | 2/1992 | Leclercq |
| 5,482,069 | A | * | 1/1996 | Lee |

* cited by examiner

*Primary Examiner*—Robert Canfield
(74) *Attorney, Agent, or Firm*—Salter & Michaelson

(57) ABSTRACT

A portable shelter including a light-weight frame that is collapsible and supports a strong, light-weight covering or skin that is removably secured to the frame is disclosed. The frame may include a base which supports a plurality of articulated arms that are movable between an extended and a non-extended position by the provision of a tension wire. A main roof having an opening therethrough is positioned over the articulated arms and tension wire in the assembled position. The opening is sized to receive an umbrella unit therethrough. The umbrella unit is preferably movable between an open and closed position. When in the open position the umbrella unit forms part of a continuous roof of the shelter, and in the closed, or partially closed position, the umbrella unit extends upwardly such that the interior of the tent is fluidly connected to the outer atmosphere through the opening in the main roof.

20 Claims, 15 Drawing Sheets

PORTABLE SHELTER AND METHOD OF ASSEMBLING THE SAME

DESCRIPTION

1. Technical Field

The present invention is directed to a portable shelter and, more specifically to a portable, light-weight tent assembly which can be utilized for shelter for an extended period of time.

2. Background of Related Art

Tents and other portable shelters are utilized in a variety of situations in order to provide relief from the elements. For example, tents have long been utilized for outdoor activities such as camping, and have also been utilized in times of emergencies in order to provide temporary housing, to create first-aid stations and for storage of supplies. Various style portable tents have been designed which can be used to provide shelter. In many situations, such portable shelters are utilized for relatively short periods of time, for example a week or less. Most of these portable shelters are primarily utilized to provide shelter at night and during inclement weather. Generally, desirable features of portable shelters utilized for recreational and other purposes are ease of assembly, ease of dis-assembly, lightweight, compactness and portability of the tent when packed. More and more tents and other portable structures are being utilized in survival and/or emergency situations where they may be needed for extended periods of time and in changing circumstances. For example, when people have lost their homes such as during disasters for example a hurricane, or for the housing of refugees or other such persons. In such cases, the durability of the structure as well as the ability to use the structure not only as a shelter, but as a make-shift house becomes important.

Therefore, there is needed in the art a light-weight, portable shelter which is relatively easy to assemble and which may be utilized for shelter over an extended period of time.

SUMMARY

An object of the present invention is to provide a light-weight, portable shelter which is relatively easy to assemble and durable so as to be able to be used as a shelter over an extended period of time, for example for a week or more.

In accordance with one aspect, there is provided a portable shelter including a light-weight frame that is collapsible and supports a strong, light-weight covering or skin that is removably secured to the frame. In one embodiment, the frame preferably includes a base which supports a plurality of articulated arms that are movable between an extended and a non-extended position by the provision of a tension wire which is connected to each of the arms. A main roof is positioned over the articulated arms and tension wire in the assembled position such that at least part of the tension is preferably transferred to the roof. In one embodiment, an opening is formed in the main roof which is sized to receive an umbrella unit therethrough. The umbrella unit preferably includes a plurality of telescoping arms supported on the base, the telescoping arms further being attached to upper arms of the umbrella unit. The upper arms may also be attached at one end thereof to a flexible disc member and are covered by umbrella roof material. The telescoping arms are a extendable and retractable in order to move the umbrella unit between the open and closed positions. In the open position the telescoping arms are positioned substantially parallel to the ground such that the umbrella unit forms part of a continuous roof of the shelter. In the closed, or partially closed position, the upper arms of the umbrella unit extend in an upward direction from the ground such that the interior of the tent is fluidly connected to the outer atmosphere through the opening in the main roof. Tubular legs and side walls may also be provided in order to further enclose the shelter from the elements in the assembled position. When assembled, the shelter is durable and provides an environment which may be inhabited for extended periods of time. Once dis-assembled, the shelter is compact, light weight and portable.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

A portable shelter 10 which is relatively easy to assemble and durable so as to be able to be used as a shelter over extended periods of time, is illustrated in FIGS. 1–21. As used herein, the term "shelter" refers to a device which provides protection from various elements, for example wind and rain, to the user. The term "portable" is used herein in a conventional sense to mean capable of being carried or moved. Also as used herein, the term "tent" refers to a specific type of portable shelter which includes a covering extending over a supporting framework.

Figure 1:
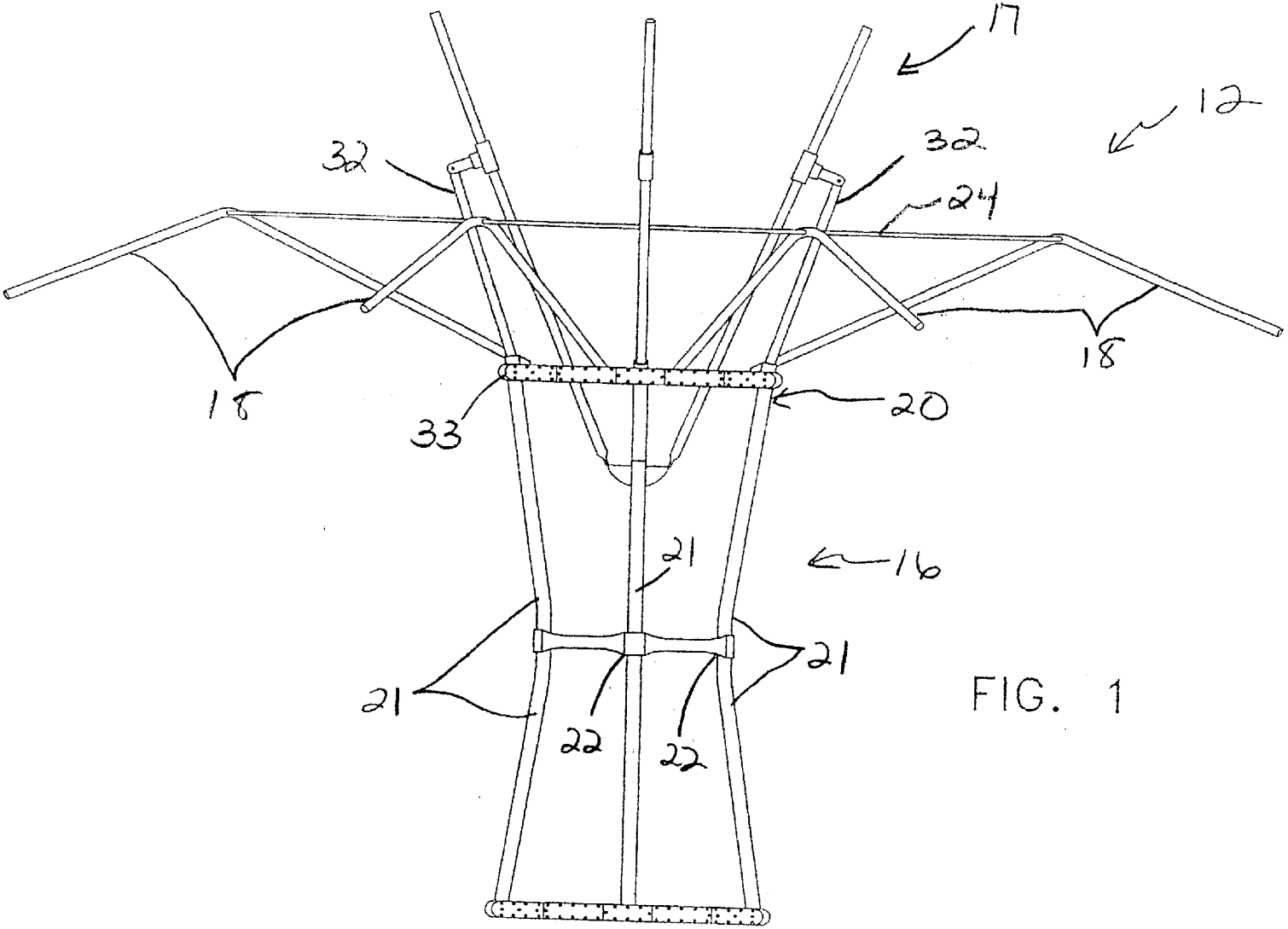
FIG. 1 is a front view of the framework of the portable shelter including a base and an umbrella unit in an open position.
Figure 2:
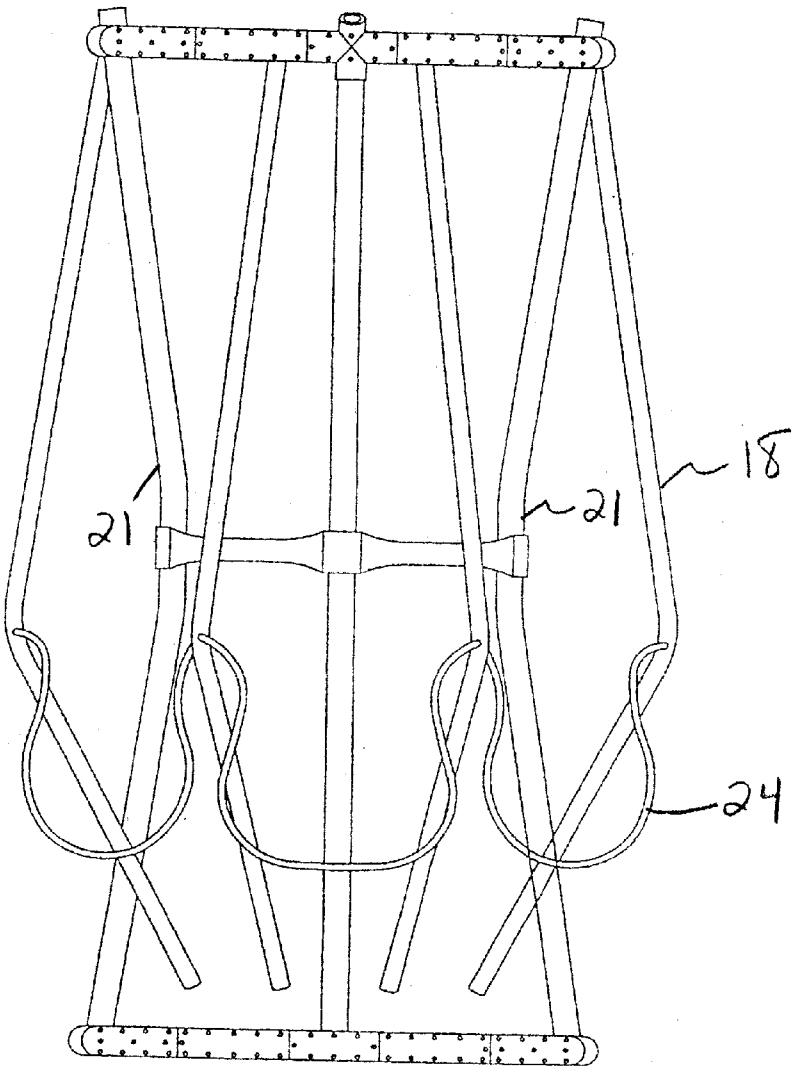
FIG. 2 is a front view of the framework of the portable shelter including a base and an umbrella unit in a closed or collapsed position.
Figure 4:
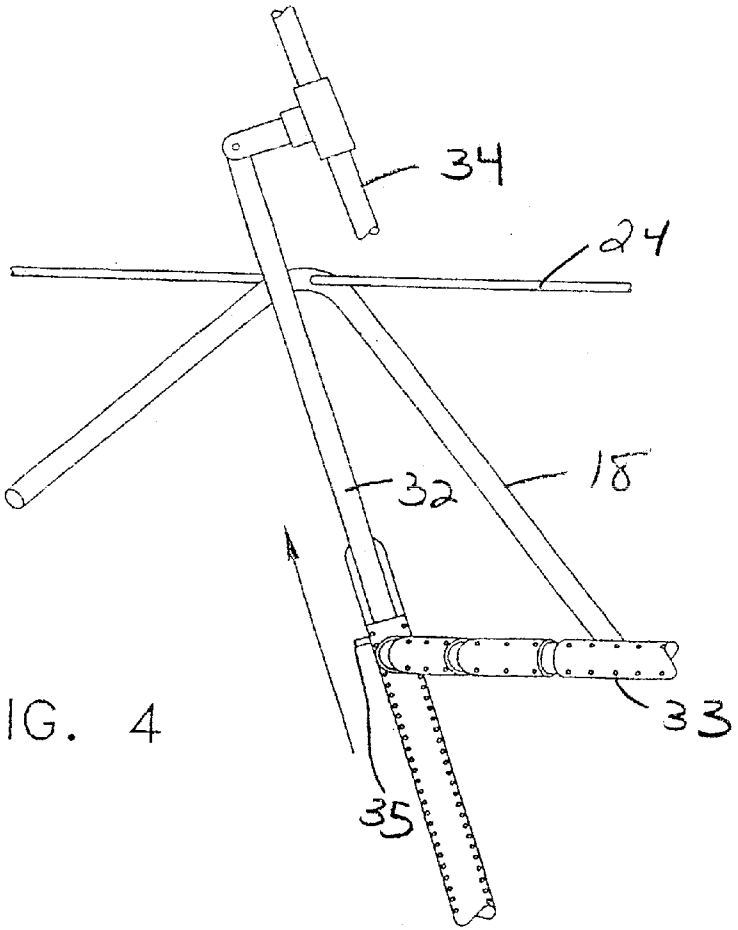
FIG. 4 is an enlarged plan view of an arm of the umbrella unit in an extended position.
Figure 3:
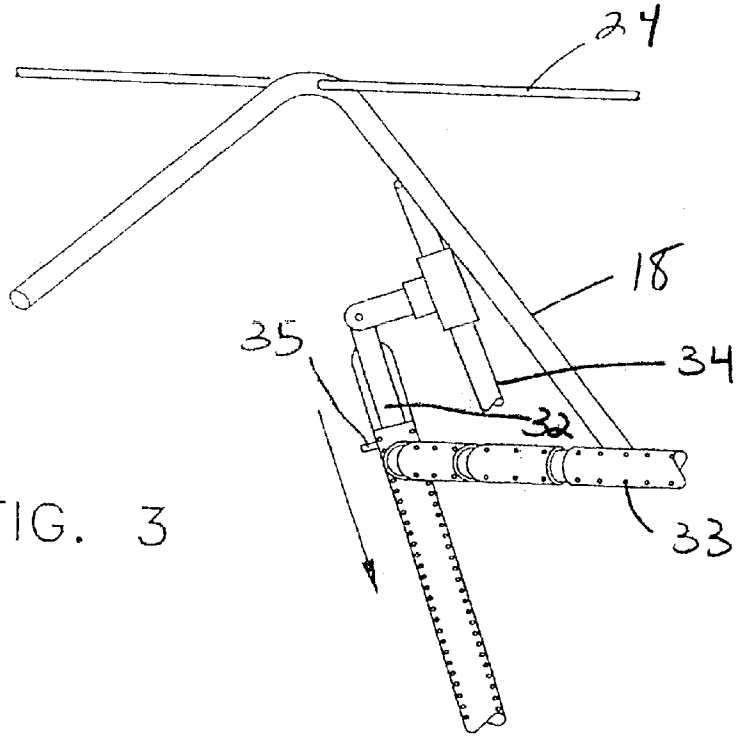
FIG. 3 is an enlarged plan view of an arm of the umbrella unit in a retracted position.
Figure 6:
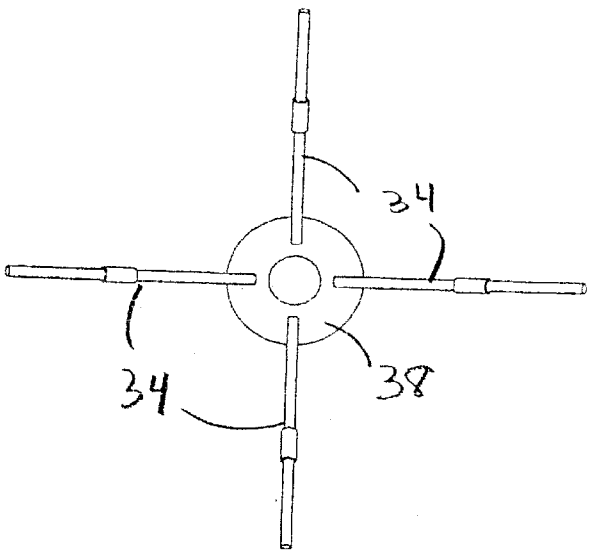
FIG. 6 is a top plan view of the umbrella unit in the retracted position.
Figure 5:
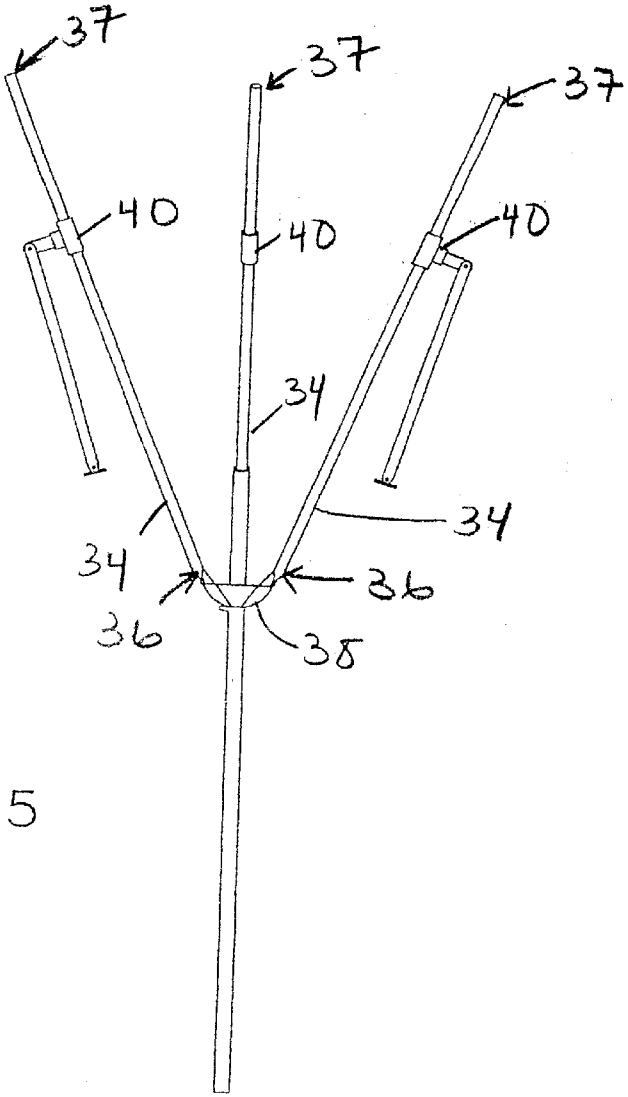
FIG. 5 is a front view of the umbrella unit in the retracted position.
Figure 18:
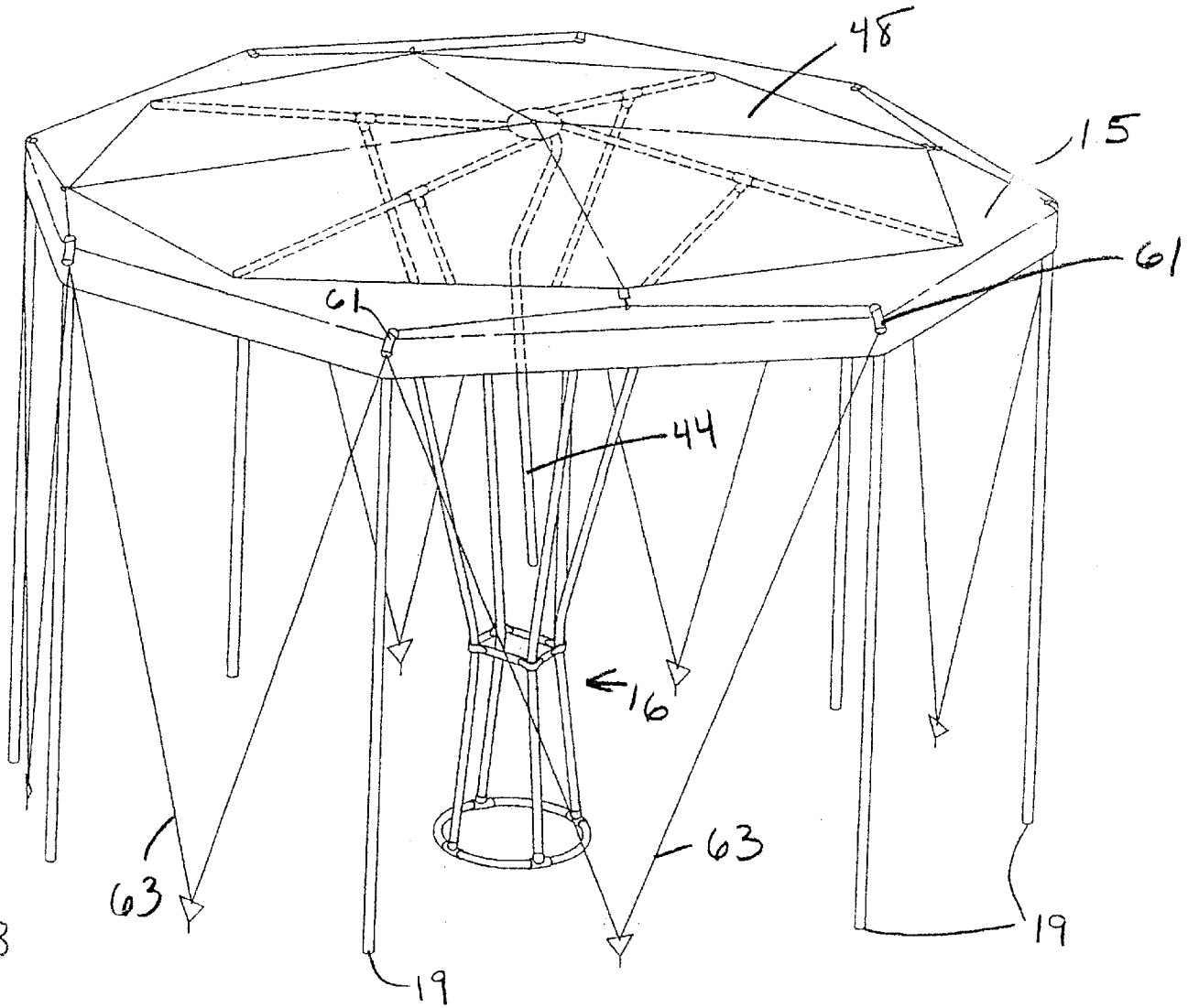
FIG. 18 is a perspective view of the tent assembly in a partially erected position with the umbrella unit extended.
Figure 19:
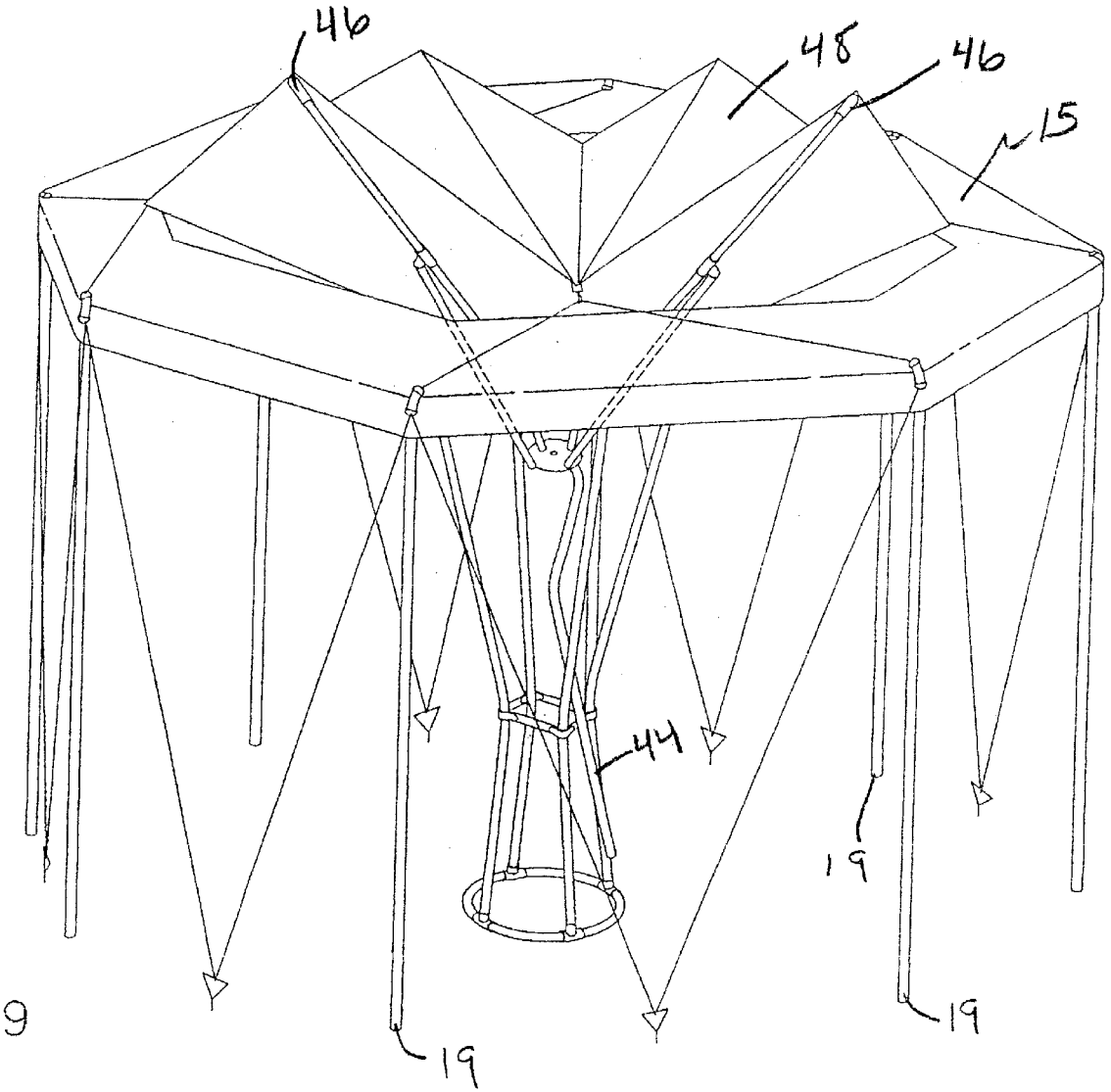
FIG. 19 is a perspective view of the tent assembly in a partially erected position with the umbrella unit partially retracted.
Figure 20:
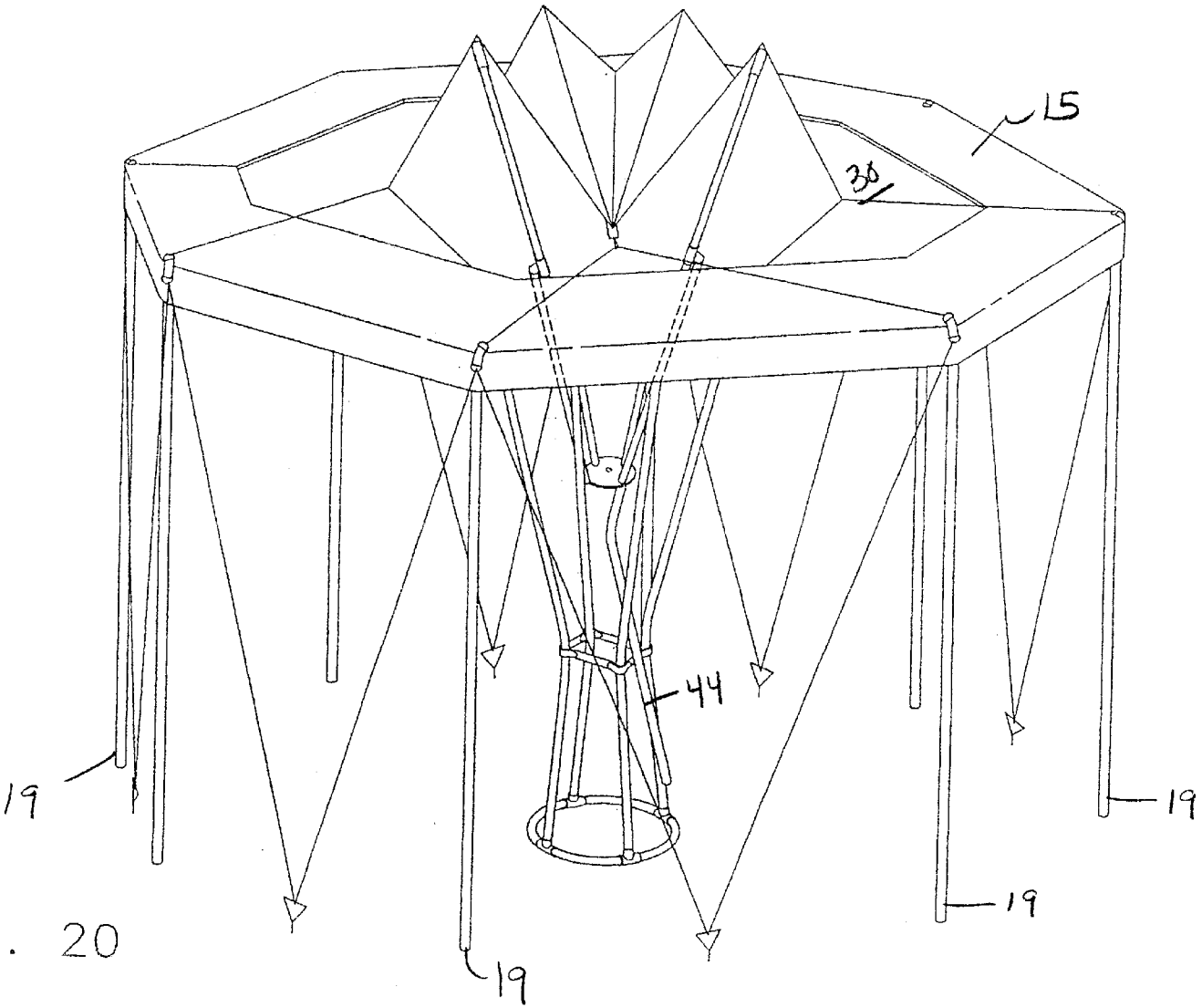
FIG. 20 is a perspective view of the tent assembly in a partially erected position with the umbrella unit fully retracted.

Referring to the Figures, the portable shelter 10 includes a light-weight frame 12 that is collapsible and supports a strong, light-weight covering or skin 14 that is removably secured to the frame. As shown in FIG. 1, the frame 12 preferably includes a base 16 and an umbrella unit 17. The frame may also further include a plurality of legs 19 (FIGS. 18–20). The base and legs are supported on a surface, such as the ground, and extend in an upward direction therefrom. The base provides support to a plurality of articulated arms 18 which are pivotally attached to the base at an upper end 20 thereof, and which preferably extend in a radial direction therefrom. The base may be formed from a plurality of tubular members 21 which are attached to each other, for example by fittings 22, into a generally cylindrical, hour-glass shape. The base may take other shapes, such as rectangular, as would be known to those of skill in the art. The articulated arms 18 are movable between an extended or assembled position, and a non-extended or dis-assembled position by the provision of a tension wire 24 which is connected to each of the arms. The tension wire may be threaded through a hole 25 in each of the articulated arms, or may alternatively be mechanically connected to each of the arms as would be known to one of skill in the art. The tension wire is used to hold and stabilize the frame in a substantially upright position prior to attaching the covering or skin, particularly the skin that forms the primary or main roof 15 of the shelter. In the assembled position, one end of the tension wire is secured to an opposite end so as to hold the articulated arms in the extended position. In order to release the arms and dis-assemble the shelter, the tension wire is disconnected or released, allowing the arms to collapse downwardly toward the ground as shown in FIG. 2. The distal ends 26 of each of the arms are adapted to be inserted into sleeves 28 disposed on the interior of the skin of the main roof 15 (FIG. 13), when assembled. Likewise, distal ends of the each of the legs 19 are adapted to be inserted within sleeves 29 disposed on the interior surface of the main roof. In use, as the roof is positioned over the articulated arms, the tension in the wire is at least partially transferred to the roof skin as described in greater detail below.

The roof 15 also preferably includes an opening 30 disposed above the upper end 20 of the base, the diameter of the opening preferably being wider than the diameter of the base. In the present embodiment, the opening is configured to receive a portion of the umbrella unit 17 therethrough. The umbrella unit 17 preferably includes a plurality of telescoping support arms or poles 32 that extend from and are supported by the base 16. As shown in FIG. 1, the telescoping arms may preferably be attached to the upper end 20 of the base, along ring 33 on which the articulated arms 18 are preferably also supported. The telescoping arms may preferably be extended and retracted by a user, and are each preferably held in a desired position by pins 35 which engage apertures disposed in the arms. Alternatively, the telescoping arms may be held in a desired position by other devices, as would be known to those of skill in the art. Each of the telescoping arms is attached to a corresponding upper arm 34 of the umbrella unit. The upper arms 34 each include a proximal end 36 which is preferably supported by a flexible, articulating member such as disc 38, a distal end 37 opposite the proximal end. A fitting, such as a T-shaped joint 40 may be positioned between the proximal and distal ends, the fitting being used to connect the upper arms to the telescoping arms such that the telescoping arms are slidable along the upper arms. In a fully retracted position (FIG. 3), the telescoping arms are positioned such that the upper arms 34 extend in an upward direction from the ground as shown in FIG. 1, through the opening 30 in the main roof 15 (when attached). In a fully extended position (FIG. 4), the telescoping arms are positioned such that the upper arms are substantially parallel to the ground, in the plane of the roof 15 as shown in FIG. 18. In this manner, the umbrella material covers the opening and forms a substantially continuous roof structure with the main roof. The telescoping arms may also be positioned intermediate the fully extended and retracted positions such that the umbrella unit is in an intermediate position as shown in FIG. 19.

Figure 7:
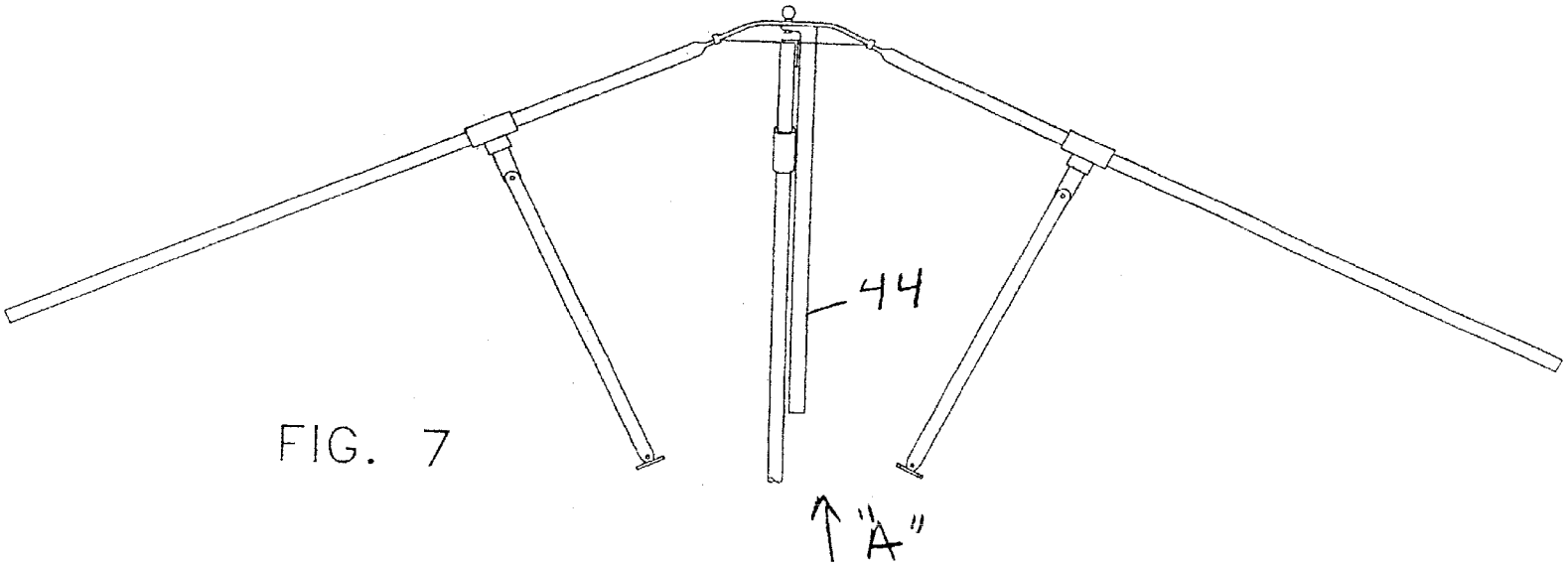
FIG. 7 is a side view of an upper portion of the umbrella unit in the extended position.
Figure 8:
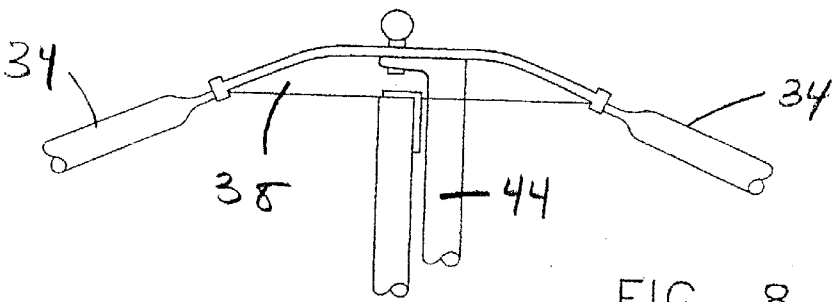
FIG. 8 is an enlarged side view of the upper end of the umbrella unit including a flexible disc member.
Figure 10:
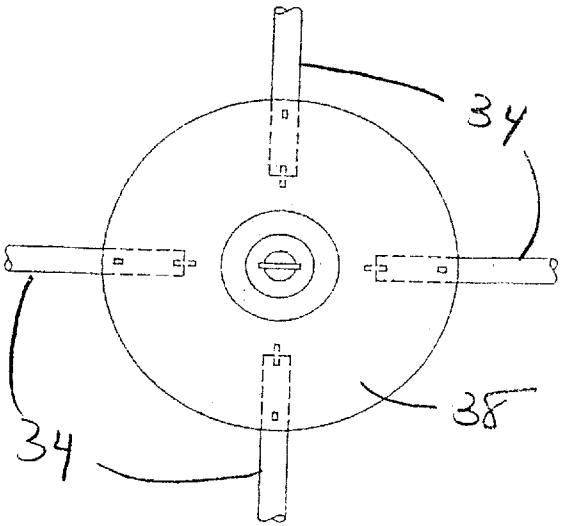
FIG. 10 is a bottom plan view of the flexible disc member.
Figure 9:
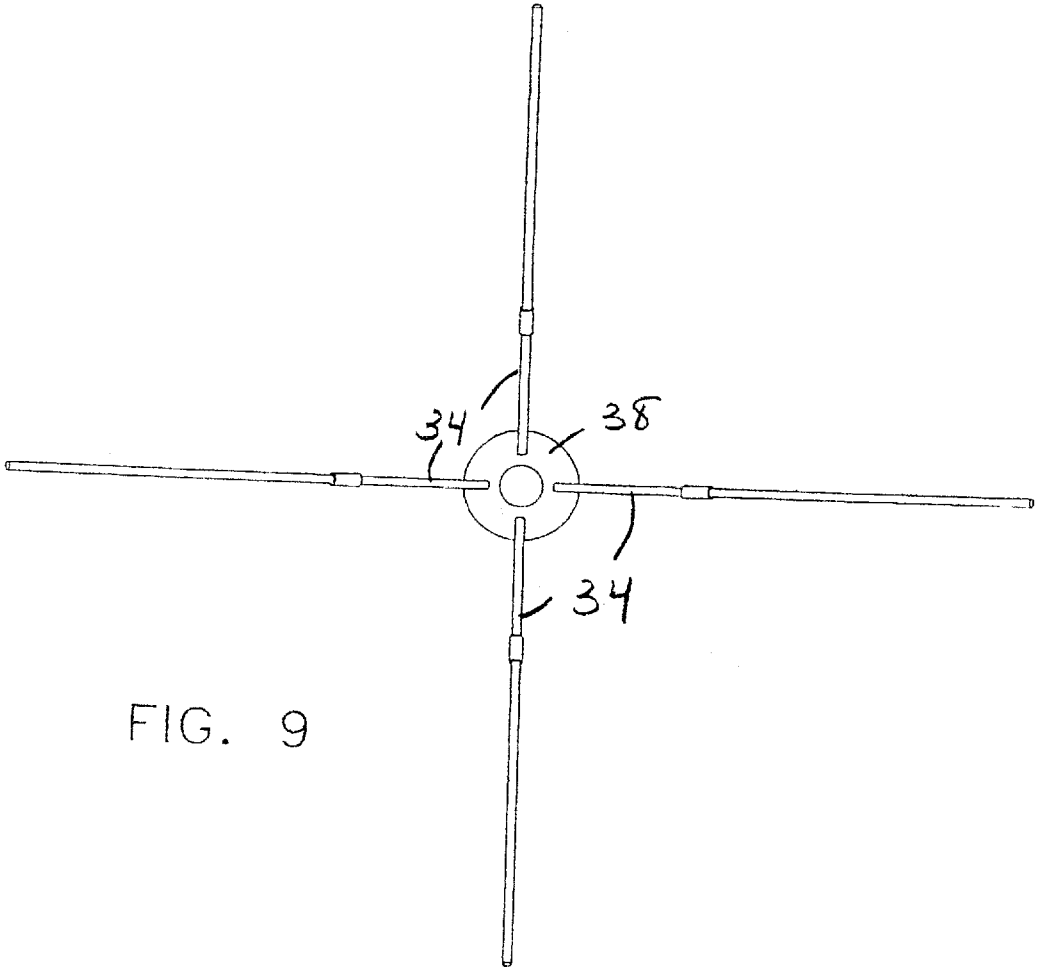
FIG. 9 a top plan view of the umbrella unit in the extended position including the flexible disc member.
Figure 11:
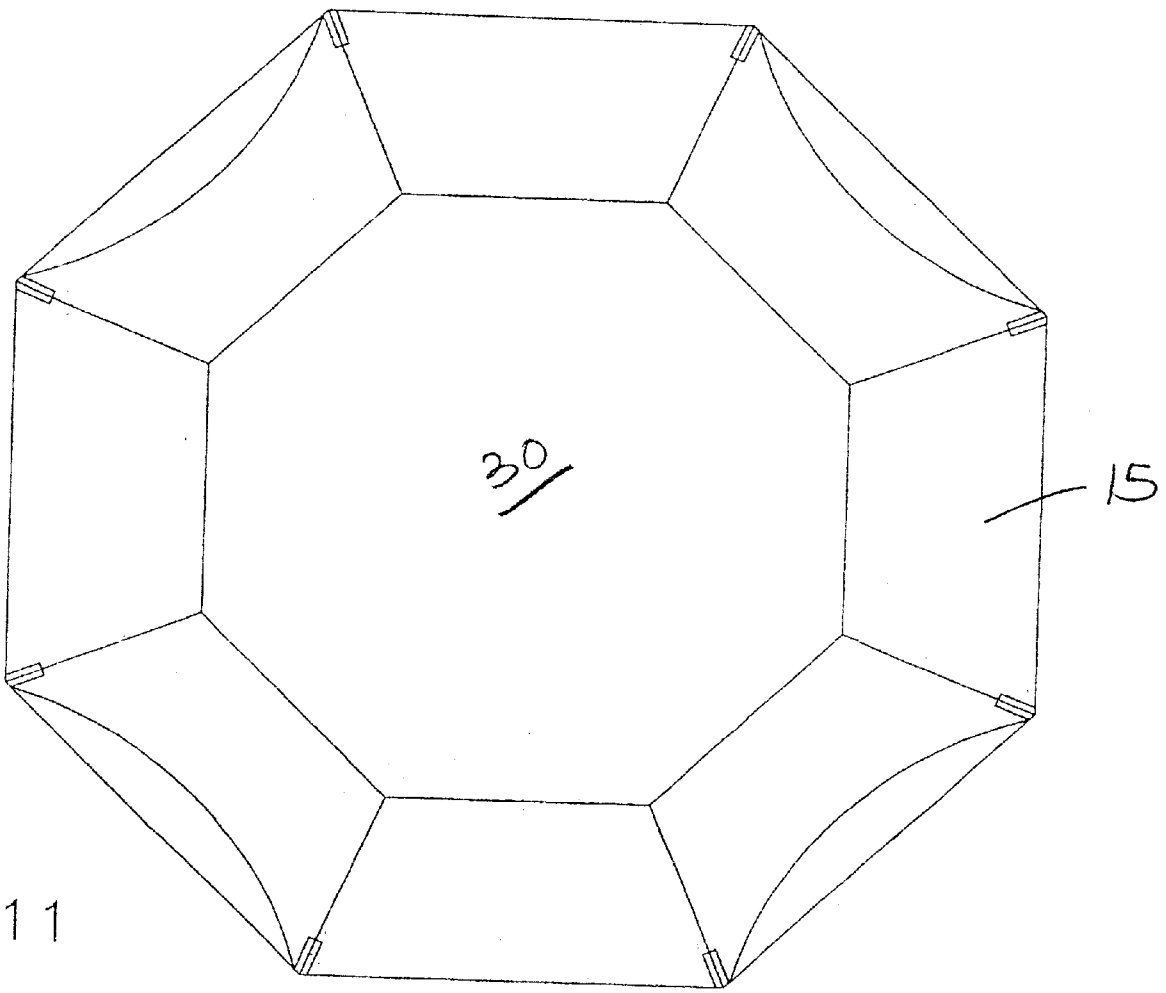
FIG. 11 is a top plan view of the base of the tent assembly including an outer covering.
Figure 12:
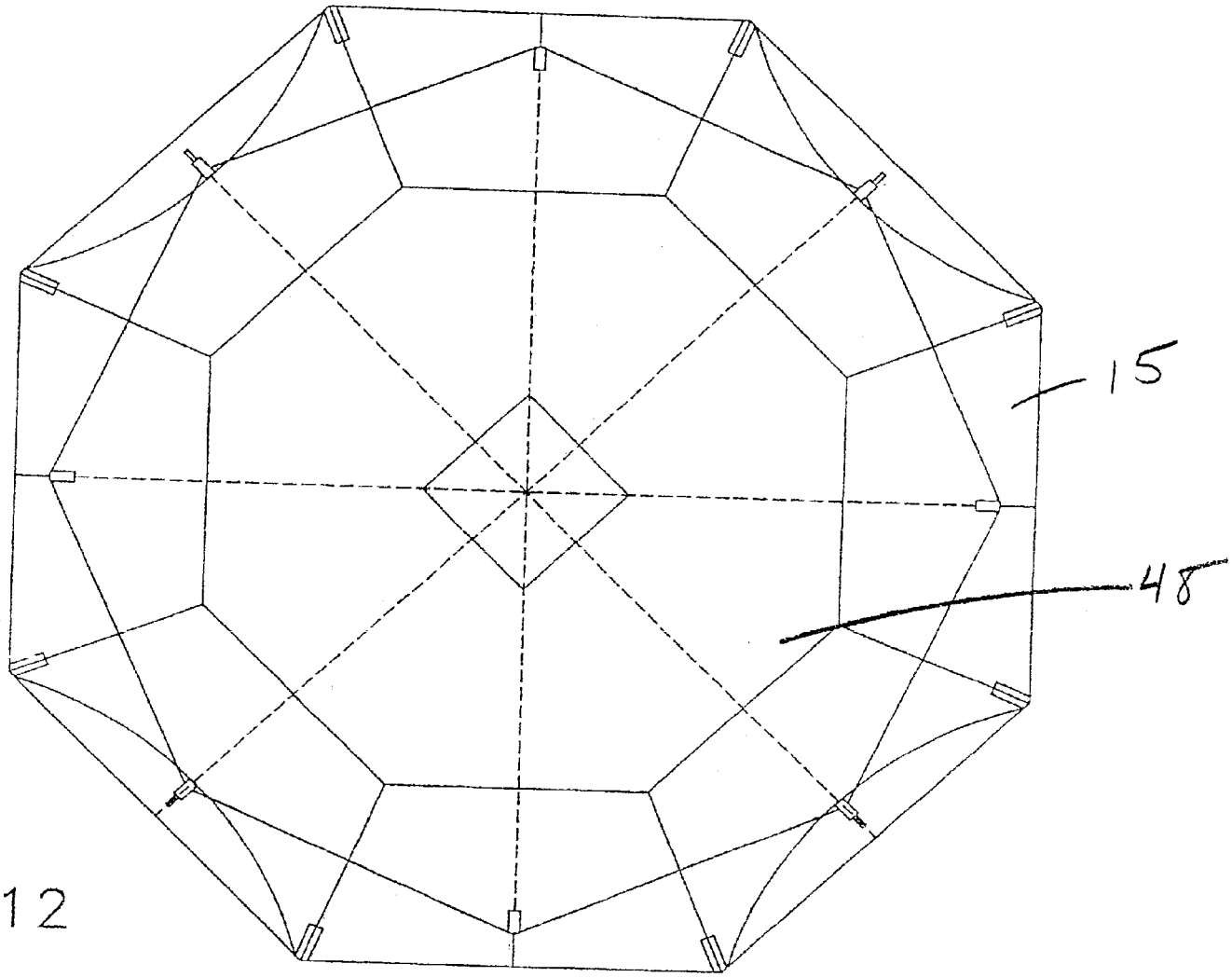
FIG. 12 is a top plan view of the base and umbrella unit of the tent assembly including a roof membrane attached to the umbrella unit.
Figure 13:
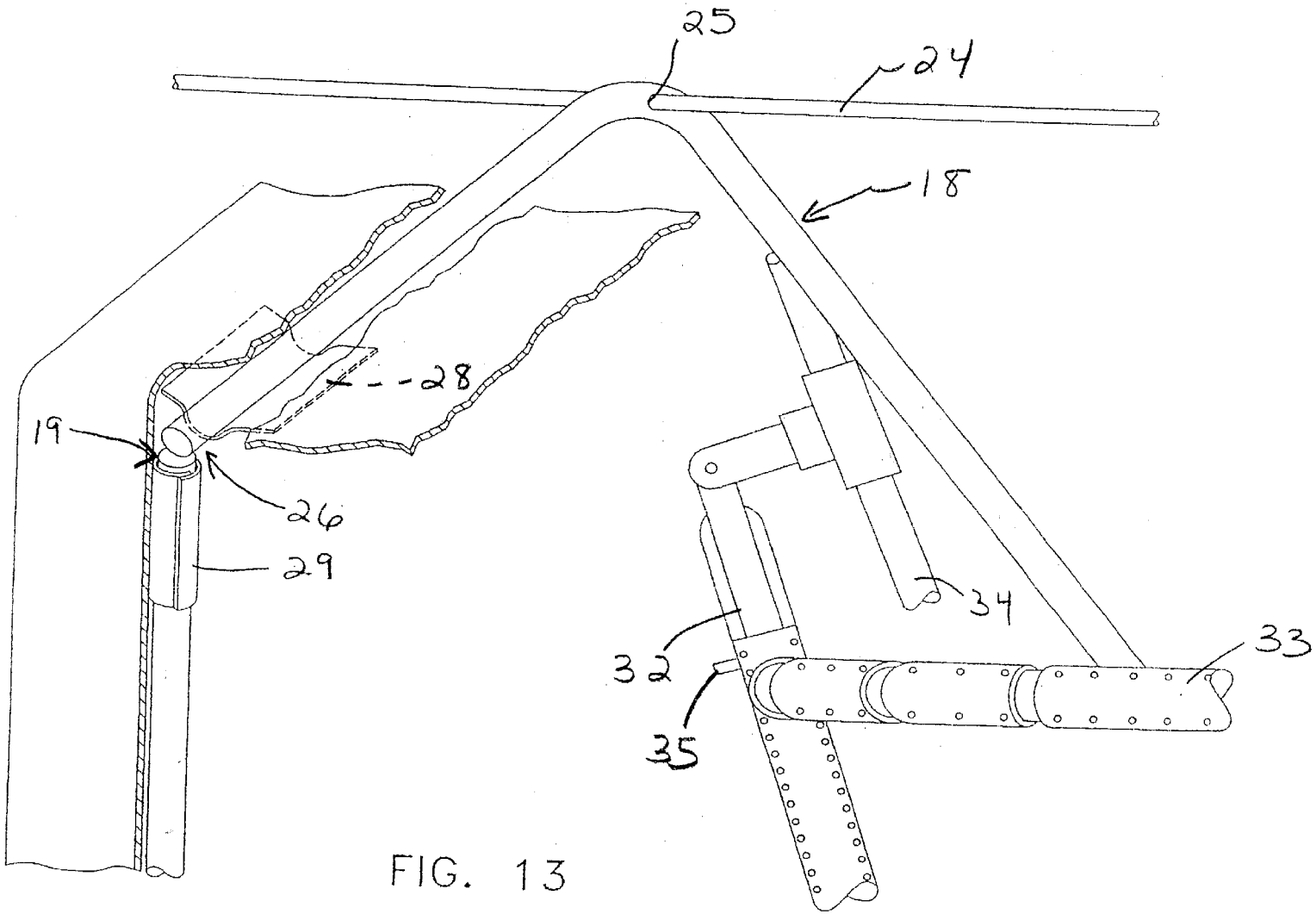
FIG. 13 is an enlarged, partially cut-away view showing parts of the frame received within sleeves in the outer covering of the shelter.
Figure 14:
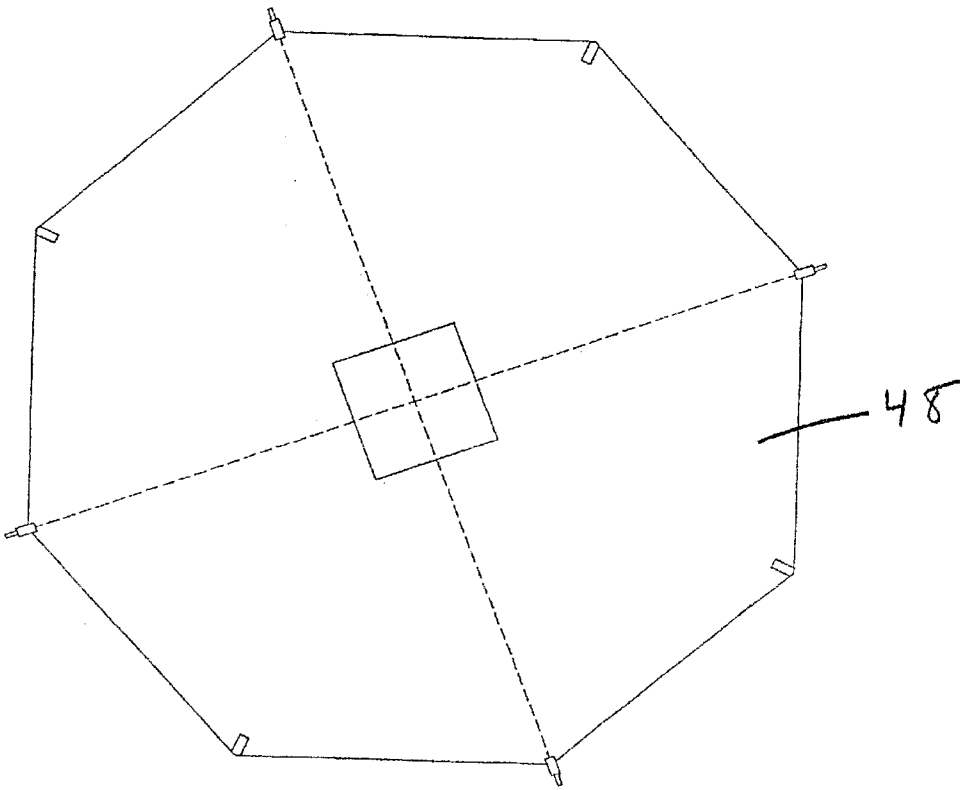
FIG. 14 is a top plan view of the roof membrane in an open position.
Figure 15:
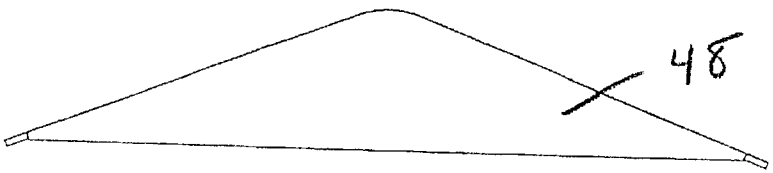
FIG. 15 is a side view of the roof membrane of FIG. 12.
Figure 16:
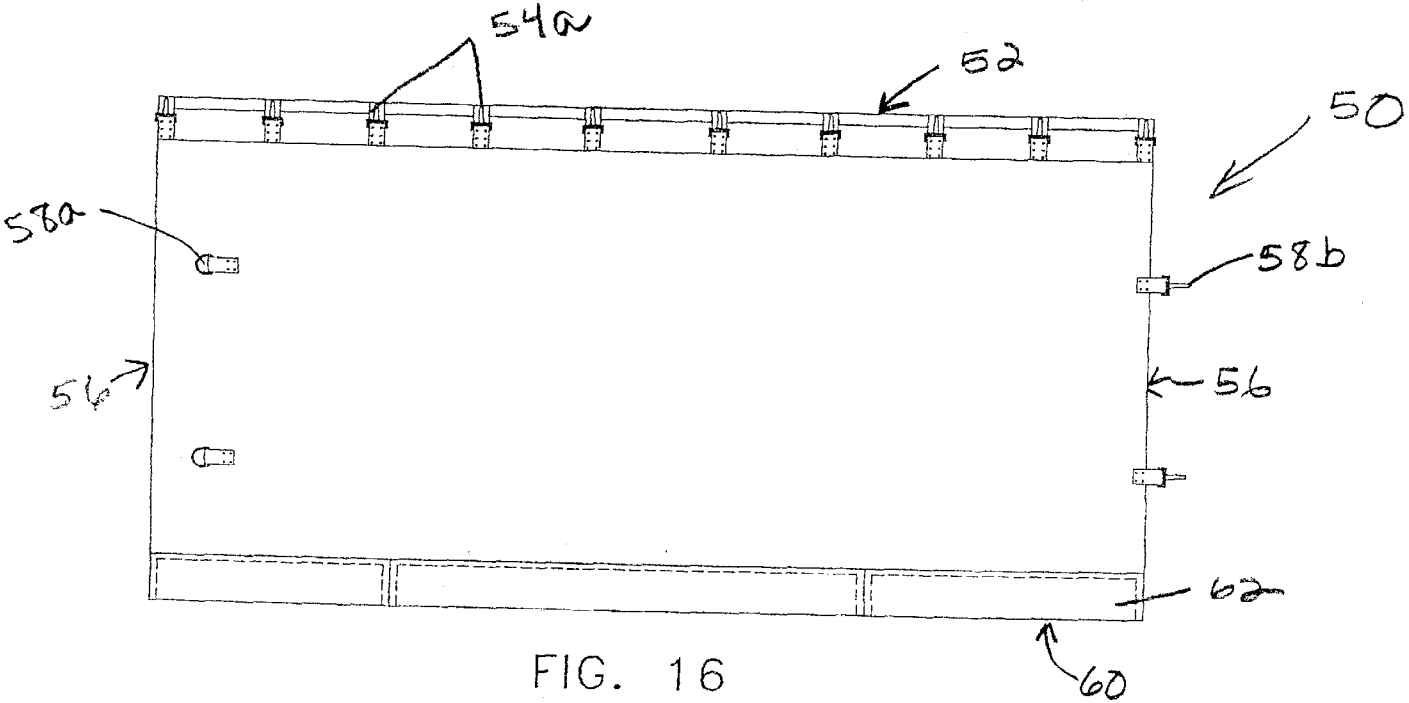
FIG. 16 is a side view of one panel of the outer covering.
Figure 17:
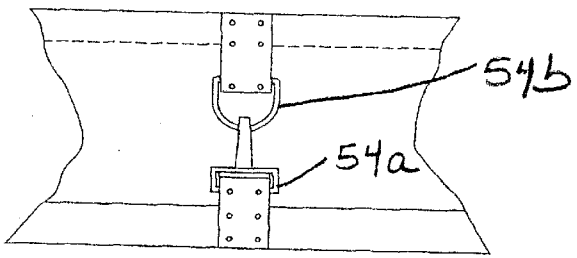
FIG. 17 is an enlarged view of an attachment mechanism for the panels of the outer covering.

In order to extend and retract the telescoping arms, an engagement member or rod 44 is attached to the articulating disc 38 (FIG. 7). When a user applies a sufficient upward force to the engagement member 44 (arrow "A"), the disc moves upward, flexes outward and the upper arms move from their upward position (FIG. 1) radially outward toward the extended position (FIG. 18) in a similar fashion to an umbrella opening. The articulating disc is preferably made of a plurality of layers of flexible material, for example silicone rubber, which allows the disc to flex into a variety of complex positions as the umbrella unit is being opened and closed. Attached to the upper arms of the umbrella unit is a covering or skin 48 which is sized to extend over and cover the opening 30 when the umbrella unit is in the open, or extended position. The distal end of each of the upper arms is preferably received within a pocket 46 formed on the inner surface of the umbrella material 48 (FIG. 19). The provision of opening 30 in the main roof 14 and the inclusion of umbrella unit 17 allows the interior of the tent to be fluidly connected to the atmosphere around the tent by allowing sunlight and fresh air to be readily received within the tent by at least partially closing or retracting the umbrella unit. This allows the interior of the shelter to be utilized for a variety of purposes. For example, a fire may be built within the shelter since ventilation can be provided through the opening when the umbrella is at least partially retracted. In addition, when the umbrella unit is fully retracted the umbrella forms a pouch-like member which allows for collection of rain water for use by inhabitants of the shelter (FIG. 20).

Figure 21:
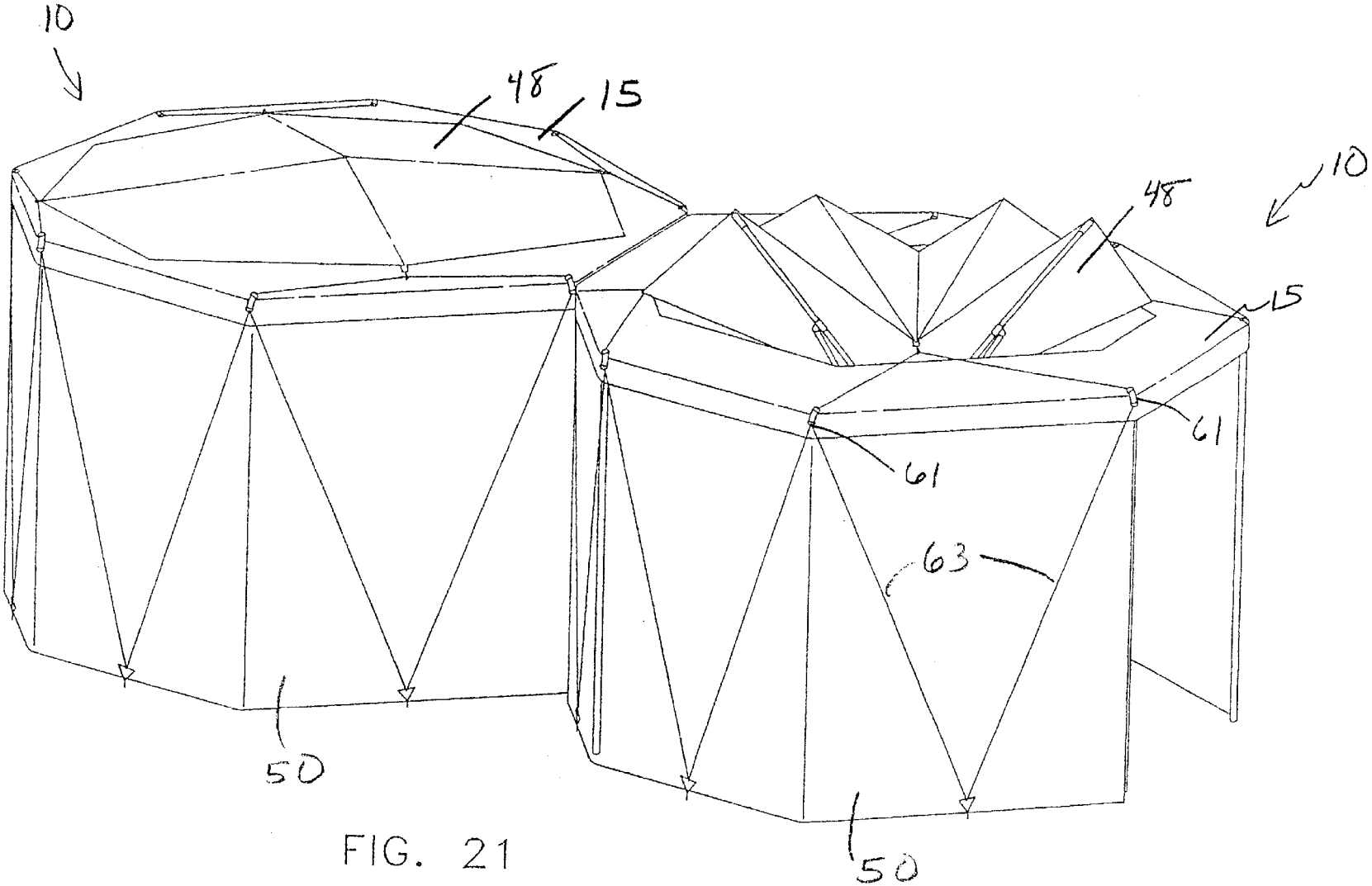
FIG. 21 is a perspective view of two fully erected tent assemblies joined along a common wall, one tent assembly with the umbrella unit in the extended position, the other with the umbrella unit in the partially retracted position.

After the base 16 and legs 19 of the shelter are erected, and the primary roof 15 is positioned over the tensioned articulated arms 18, one or more side walls 50 are attached to the shelter. The side walls 50 are preferably modular and may be made from a variety of different materials, for example Tyvek®, depending on the climate or cultural conditions in which the shelter is being utilized. The side walls are removably attached at a top portion 52 to the primary roof 15 by fasteners for example hooks 54*a* supported on the side wall which releasably engage D-rings 54*b* on the roof. The ends 56 of the side walls may likewise be releasably attached together by fasteners 58*a, b*. In addition, the ends 56 of adjacent side walls may overlap in the assembled position such that the width of the side wall between the legs can be adjusted by adjusting the amount of overlap. This allows for flexibility in the size of the opening between the legs such that the overall size of the shelter can be changed. In addition, by removing one or more side walls 50, several shelters may be joined together as shown in FIG. 21. The bottom 60 of the side walls may include a reinforced portion 62 which may by positioned within a trench dug into the ground and covered by a filler, such as dirt, in order to provide added support. In addition, a plurality of fasteners 61 may be attached to the roof for receiving one or more secondary wires or cords 63 which helps to secure the roof to the ground.

The shelter may be made in any diameter, by adjusting the size of the individual components of the frame. Preferably, the shelter is sized to house a family of 4–6 over a period of time of a week or more. It has been found that an appropriate diameter in such a circumstance is between about 10'–15'.

Use of the portable shelter 10 will now be described with reference to the drawings.

In use, the base and legs are preferably supported on a surface, such as the ground, and extend in an upward direction therefrom. The proximal ends of the legs are preferably at least partially inserted into the ground, while the bottom portion of the base preferably rests atop the ground. The umbrella unit is positioned within the base and the telescoping arms of the umbrella unit are attached to the upper end of the base. The articulated arms are then extended radially outward by securing one end of the tension wire to the other. Once the tension wire is secured, the covering which forms the main roof is place over the arms, and the distal ends of the arms and the legs are inserted into sleeves formed on the inner surface of the roof. In this manner, at least part of the tension is transferred to the roof. The roof material for the umbrella unit may also be attached at this time by inserting the distal ends of each of the upper arms of the unit into a pocket or sleeve formed on the inner surface of the umbrella roof material. Once the roof is assembled, the side walls may thereafter be attached by fastening the tops of the side walls to the bottom edge of the main roof, for example by inserting hooks attached to the top of the side walls into D-rings attached to the roof. The ends of the side walls may preferably overlap and may likewise be fastened together by the use of D-rings and hooks. A trench may also be dug around the outer perimeter of the shelter and the bottom of the side walls may be buried therein to provide added support. The roof may further be attached to the ground by a plurality of exterior wires or cords. In order to allow sunlight and air into the shelter, the umbrella unit is retracted, for example by pulling the engagement pole operatively connected to the flexible disc toward the ground. In this manner, the disc moves downward and the upper arms extend in an upward direction, through the opening in the main roof (FIG. 20). To close the shelter from the elements and protect the interior, the umbrella unit is extended, for example by pushing on the engagement rod in a direction away from the ground with a sufficient force to move the disc upward so as to extend the upper arms radially outward. When fully extended, the material of the umbrella covers the opening and forms a continuous roof structure. In order to dis-assemble the shelter, the side walls and roof is first removed. Thereafter the tension wire is released so as to collapse the articulated arms. The telescoping arms of the umbrella unit are retracted and the base, umbrella unit and legs are removed from the ground and secured in a portable package, for example by wrapping the covering around the frame elements. It will be appreciated that when assembled the shelter is durable and provides an environment which may be inhabited for extended periods of time. Once dis-assembled, the shelter is compact, light weight and portable. Therefore, the shelter as described is well suited for survival and/or emergency situations where they may be needed for extended periods of time and in changing circumstances. For example, when people have lost or left their homes.

It will be understood that various modifications may be made to the embodiments disclosed herein. For example, it should be understood that a variety of materials may be utilized for the shelter, that the stated dimensions are for an illustrative embodiment, that a variety of fasteners may be utilized other than those illustrated, and that the shelter may have alternate shapes other than those shown, depending upon the particular configuration of the frame and covering. In addition, the shelter may be erected by utilizing a frame having a base and umbrella unit, without the legs, under certain circumstances. Therefore, the above description should not be construed as limiting, but merely as exemplifications of preferred embodiments. Those skilled in the art will envision other modifications within the scope, spirit and intent of the invention.

What is claimed is:

1. A portable shelter comprising:

a frame constructed and arranged to be disposed on a support surface and including:

a) a base;

b) a plurality of articulating arms supported by the base and movable between an extended position in which the arms are under tension and a collapsed position in which tension is not applied to the arms;

c) a tension wire constructed and arranged to at least partially support each of the articulating arms in the extended position;

d) an umbrella unit movable between an open and a closed position including:

i.) a flexible member;

ii.) a plurality of telescoping arms, each telescoping arm including a first end supported by the base and a second end, opposite the first end, constructed and arranged to support an upper arm, the telescoping arms being movable by a user between an extended position in which the umbrella unit is open and a retracted position in which the umbrella unit is closed;

iii.) a plurality of upper arms, each upper arm having a proximal end operatively connected to the flexible member, a distal end opposite the proximal end, and an intermediate portion along which each upper arm is connected to a corresponding telescoping arm;

iv.) a fitting constructed and arranged to connect corresponding upper arms and telescoping arms;

an outer covering constructed and arranged to be removably secured to the frame, the outer covering including a primary roof portion positionable over at least a portion of the articulating arms and having an opening disposed therethrough, the opening having a diameter which is sized to receive at least a portion of the umbrella unit therethrough, and an umbrella covering constructed and arranged to be supported and moved by the upper arms of the umbrella unit; and wherein in an assembled position the umbrella unit is movable between a closed position in which the upper arms extend in an upward direction from the support surface and through the opening in the roof such that an interior portion of the shelter is in fluid communication with the outside atmosphere through the opening, and an open position in which the upper arms are substantially parallel to the support surface such that the opening is covered by the umbrella covering to form a substantially continuous roof.

2. The portable shelter of claim 1, wherein the articulating arms include proximal ends which are pivotally attached to an upper end of the base and which extend radially therefrom in the extended position.

3. The portable shelter of claim 2, wherein the articulating arms include distal ends constructed and arranged to be received within sleeves disposed on the interior of the roof portion.

4. The portable shelter of claim 1, wherein the base comprises a plurality of light-weight tubular members which are secured together.

5. The portable shelter of claim 4, wherein the tubular members are secured together to form a generally cylindrical, hour-glass shape.

6. The portable shelter of claim 1, wherein the tension wire is threaded through holes disposed in the articulated arms.

7. The portable shelter of claim 1, wherein tension in the wire is at least partially transferred to the roof portion in the assembled position.

8. The portable shelter of claim 1, wherein the diameter of the opening is wider than a diameter of the base at an upper end thereof.

9. The portable shelter of claim 1, wherein the telescoping arms are securable in any number of positions from fully extended to fully retracted by a fastening member.

10. The portable shelter of claim 1, further comprising an engagement member constructed and arranged to extend and retract the telescoping arms.

11. The portable shelter of claim 10, wherein the engagement member is a rod having a first end operatively connected to the flexible member.

12. The portable shelter of claim 1, wherein the flexible member is disc-shaped and formed of a plurality of layers of flexible material such that the disc can flex into a variety of positions as the umbrella unit is being moved between the open and closed positions.

13. The portable shelter of claim 1, wherein the umbrella covering includes a plurality of pockets constructed and arranged to each receive the distal end of an upper arm.

14. The portable shelter of claim 1, wherein the frame further comprises a plurality of legs constructed and arranged to provide support to the shelter.

15. The portable shelter of claim 1, wherein the outer covering further comprises one or more side walls removably attachable to the frame.

16. The portable shelter of claim 15, wherein each side wall includes a top portion constructed and arranged to be removably secured to the primary roof by a fastener, first and second ends, and a bottom.

17. The portable shelter of claim 16, wherein in the assembled position the ends of the side walls overlap such that a first end of one side wall partially covers a second end of an adjacent sidewall and wherein the amount of overlap is adjustable by the user.

18. A portable shelter comprising:

a frame constructed and arranged to be disposed on a support surface and including:

a) a base having a diameter;

b) a plurality of articulating arms each including a proximal end pivotally attached to an upper end of the base and movable between an extended position in which the arms are under tension and a collapsed position in which tension is not applied to the arms;

c) a tension wire constructed and arranged to at least partially support each of the articulating arms in the extended position;

d) a plurality of legs; and e) an umbrella unit movable between an open and a closed position including:

i.) a flexible member;

ii.) a plurality of telescoping arms, each telescoping arm including a first end supported by the base and a second end, opposite the first end, constructed and arranged to support an upper arm, the telescoping arms being movable by a user between an extended position in which the umbrella unit is open and a retracted position in which the umbrella unit is closed, and wherein the telescoping arms are securable in a number of positions from fully extended to fully retracted by a fastening member;

iii.) a plurality of upper arms, each upper arm having a proximal end operatively connected to the flexible member, a distal end opposite the proximal end, and an intermediate portion along which each upper arm is connected to a corresponding telescoping arm;

iv.) a fitting constructed and arranged to connect corresponding upper arms and telescoping arms; and v.) an engagement member operatively connected to the flexible member and constructed and arranged to extend and retract the telescoping arms;

an outer covering constructed and arranged to be removably secured to the frame, the outer covering including a primary roof portion positionable over at least a portion of the articulating arms and having an opening disposed therethrough, the opening having a diameter which is sized to receive at least a portion of the umbrella unit therethrough and which is greater than the diameter of the base at the upper end thereof, an umbrella covering constructed and arranged to be supported and moved by the upper arms of the umbrella unit, and one or more side walls removably attachable to the frame; and wherein in an assembled position the umbrella unit is movable between a closed position in which the upper arms extend in an upward direction from the support surface and through the opening in the roof such that an interior portion of the shelter is in fluid communication with the outside atmosphere through the opening, and an open position in which the upper arms are substantially parallel to the support surface such that the opening is covered by the umbrella covering to form a substantially continuous roof.

19. A method of assembly a portable shelter comprising the steps of:

placing a base having a plurality of articulating arms on a support surface;

extending the articulated arms radially from the base;

securing the articulated arms in the extended position by placing the arms under tension;

supporting an umbrella unit on the base, the umbrella unit having a plurality of telescoping arms which are movable by a user between an extended position in which the umbrella unit is open and a retracted position in which the umbrella unit is closed, a plurality of upper arms operatively connected to the telescoping arms; and a flexible member operatively connected to the upper arms;

attaching a roof over a portion of the articulated arms, the roof including an opening sized to receive the umbrella unit therethrough; and moving the umbrella unit between a closed position in which the upper arms extend in an upward direction from the support surface and through the opening in the roof such that an interior portion of the shelter is in fluid communication with the outside atmosphere through the opening, and an open position in which the upper arms are substantially parallel to the support surface such that the opening is covered by the umbrella covering to form a substantially continuous roof.

20. The method of claim 19, further comprising the step of securing the roof to the ground with secondary wires.

* * * * *